United States Patent [19]

Rich

[11] Patent Number: 4,740,656

[45] Date of Patent: Apr. 26, 1988

[54] RELEASABLE IMPROVED WIRE TERMINAL

[76] Inventor: Donald S. Rich, 15 Buttonwood Dr., Long Valley, N.J. 07853

[21] Appl. No.: 898,988

[22] Filed: Aug. 21, 1986

Related U.S. Application Data

[63] Continuation-in-part of Ser. No. 826,801, Feb. 6, 1986.

[51] Int. Cl.[4] ..... H01R 4/22

[52] U.S. Cl. ..... 174/87; 174/845

[58] Field of Search ..... 174/87, 845, 203

[56] References Cited

U.S. PATENT DOCUMENTS

| | | | |
|---|---|---|---|
| 3,075,038 | 1/1963 | Schinske | 174/87 |
| 3,156,761 | 11/1964 | Schinske | 174/87 |
| 3,440,332 | 4/1969 | Blomstrand | 174/87 |
| 3,440,335 | 4/1969 | Blomstrand | 174/87 |
| 3,678,174 | 7/1972 | Ganzhorn | 174/87 X |
| 3,875,324 | 4/1975 | Waddington et al. | 174/87 |
| 4,288,657 | 9/1981 | Swanson | 174/87 |

FOREIGN PATENT DOCUMENTS

| | | | |
|---|---|---|---|
| 654131 | 4/1929 | France | 174/87 |

*Primary Examiner*—Morris H. Nimmo
*Attorney, Agent, or Firm*—Robert K. Tendler

[57] ABSTRACT

An improved wire terminal is provided in which an internal coiled spring wire clamping member is opened with the usual clockwise twist of the wire terminal when wires are inserted into the wire terminal, with an intermediate portion of the spring initially contacting the wires as they are inserted into the wire terminal such that the clockwise rotation opens an upper spring portion anchored at its end to the wire terminal. Release of the wire terminal causes the spring to collapse on itself to squeeze the wires together, thereby preventing dislodging of the wire terminal as by vibration. Further improvements include an annular lower lip in the housing for ease of spring insertion and capture; an upper U-shaped dog which prevents the upper spring dog from jumping out of its tabbed position with extremely large terminal torquing, while at the same time deflecting inserted wires off-axis to prevent terminal cap damage; and a terminal removal system including a dog on the lower portion of the spring and corresponding lost motion channels housing corresponding dogs at both the top and bottom of the terminal.

4 Claims, 5 Drawing Sheets

RELEASABLE IMPROVED WIRE TERMINAL

RELATED APPLICATIONS

This application is a continuation-in-part of application Ser. No. 826,801, filed Feb. 6, 1986.

FIELD OF THE INVENTION

This invention relates to methods and apparatus for joining electrical conductors or wires, and more particularly, to a wire terminal which includes a coiled spring clutch mechanism for initially permitting the insertion of wires into an expanded spring portion followed by collapse of this spring portion on the wires to provide for the electrical connection, as well as to improved spring insertion and holding systems, and to a wire terminal release system.

BACKGROUND OF THE INVENTION

One of the basic problems with conventional wire terminals is that they are subject to default through vibration. This means that in a building where many wire terminals may be used, and particularly in industrial type buildings, ambient vibrations in the structure are present which are induced by, for instance, air conditioning, heating or other machinery. Conventional wire terminals, because they have a tapered-type design in which a number of wires are forced together and wedged in a capheld conical spring, have a tendency to come off due to vibration in which the terminal rotates counter-clockwise over time. If the terminal does not come off, it can loosen up, and as a result, the electrical integrity of the connection is compromised. This produces hot spots and other types of faults which sometimes can be particularly difficult to trace.

Moreover, in conventional wire terminal, the plastic insultated outer jacket works as a tight girdle to restrain the tapered helical spring electrical member from expanding in a radial direction. This spring is basically seated against the outer walls of the insulator and is prevented from movement in any direction. Moreover, the spring has a closed end which limits how far the wires can be pushed into the terminal. The closure of the spring at one end does not permit accommodation of a broad range of wires, and since the spring is unable to move radially, it cannot adjust properly to the number of wires which have been inserted, thereby even further limiting the size and range of wires to be connected. Moreover, by its very construction, the conventional wire terminal also tends to create a tapered helical girdle into which the wires are inserted which produces a force component which attempts to push the wires out of the wire terminal.

SUMMARY OF THE INVENTION

In counter-distinction to the conventional wire nut described above, the subject wire terminal includes a nut housing which contains a helically wound electrically-conductive spring which is allowed to expand radially inside the wire terminal housing with clockwise rotation of the terminal. In one embodiment, the portion of the spring which contacts the inserted wires is, in general, parallel in construction as opposed to being tapered as is conventional. This provides that wires inserted into the wire terminal are held by a spring member which grasps the wires in a direction normal to the longitudinal centerline of the wires such that they are not pushed out or such that the connection does not involve an axially downward force.

More particularly, the upper end of the spring of the subject invention is anchored in a slot or tab-like structure within the wire terminal housing such that when wires are held stationary and are inserted into the wire terminal, a portion of the wires contact a lower portion of the spring, and when the wire terminal is turned clockwise then, in one embodiment, the upper portion of the spring opens, allowing further upward insertion of the wires through the expanded portion of the spring assembly. Upon release, the spring closes down upon the inserted wires, due to its spring memory, and holds the wires together in electrical contact along an extended parallel path. As such, the design resembles a spring-wound clutch in the sense that when a group of wires are applied to it, the wires may be inserted very easily with a clockwise terminal rotation, whereas counter-clockwise rotation due to the relaxing of the spring resists the tendency for the wire terminal to come off because once released the counter-rotation of the terminal causes the spring tension to increasingly grip the wires and tighten the connection.

In one embodiment, the top portion of the spring member is open so that wires may be forced through the spring and into a cavity at the top of the wire terminal housing. This permits the handling of various lengths of exposed wire such that if too much insulation has been cut off from the wire, it can be taken up within the wire terminal cavity at the top of the wire terminal.

It will be appreciated that the wire terminal housing provides clearance for the internally-carried spring to expand in a radial direction, thereby to permit ease of insertion of the wires to be connected. With each clockwise turn of the wire terminal, the spring is further expanded to permit even further insertion of the wires. Thus, there is no education required with respect to the operation of the terminal since, as far as the user is concerned, it operates in the same manner as the conventional wire terminal.

The wire terminal described above can accommodate a broader range of wires since space is provided between the outer walls of the spring and the inner walls of the terminal housing so that the spring can expand or contract to adjust appropriately to the number of wires which have been inserted. The contact area is both helical and parallel so that a longer length of the inserted wire is contacted. Since there is a parallel portion of the spring, which is the portion of the spring performing the clamping, there is no force component which is attempting to push the wires out of the wire terminal. Thus, the effect of the parallel portion of the spring is neutral and aids the wire terminal in retaining the wires.

In a further embodiment, the wire terminal is provided at its base with inwardly-projecting flexible tab portions which are utilized, in addition to the action of the wire terminal, to prevent the wires from coming out of the wire terminal once they are inserted. These tabs may contact either the wires themselves or the insulating outer jacket surrounding the wires. The tabs which project inwardly at the base aperture of the wire terminal are integral to the rest of the wire terminal housing, in one embodiment, for ease of fabrication.

In a still further embodiment, a U-shaped dog is presented at the top of the internally held spring, which U-shaped dog has two substantially vertically extending spaced apart legs or members and a horizontal top member joining the two. This U-shaped dog permits insertion of the wire up through the opened spring, with the horizontal top part of the dog deflecting any wire projecting that far, so that the deflected wire does not extend along the longitudinal axis of the wire terminal, but rather hits the top of the wire terminal housing at an angle, thereby preventing piercing of the top of the wire terminal.

Additionally, in a non-releaseable embodiment, the U-shaped dog is held in a simple slot at the top of the wire terminal such that the U-shaped dog cannot escape with extremely high torque pressure which is sometimes associated with twisting a wire terminal onto a wire. For releaseable embodiments of the wire terminal, a lost motion channel, in one embodiment an extended slot subtending 60 degrees of arc, houses the U-shaped dog. In either case, the top of the spring is held in place and does not jump out of its track or slot, even with unusually high torque being applied to the wire terminal. Thus, the upper lost motion track is utilized, in one embodiment, to permit release of the wire terminal; whereas, in the non-releaseable embodiment, the track may simply be a tight fitting slot. Note that the arcuately widened slot is a lost motion device and may be of any arcuate size, as long as sufficient lost motion is provided to permit the unlocking system to be described.

In a still further embodiment of the subject invention, a releaseable wire terminal is provided by providing a bottom ridge of the wire nut housing with an arcuate slot or channel, in one embodiment, also 60 degrees; and the base of the spring is provided with a downwardly projecting dog which is disposed in this channel. This slot too may be of any arcuate size as long as it permits enough lost motion to permit terminal wire insertion upon clockwise terminal turning.

Upon counter-clockwise rotation of the wire terminal, the dog contacts one end of the channel which opens the bottom of the spring in much the same way that the top of the spring is opened during clockwise rotation. The friction of the wire with the elongated center portion of the spring causes the spring to open up during the counter-clockwise rotation due to the rotation of the dog at the lower portion of the spring. This permits removal of the wires carried by the wire terminal, with the upper portion of the spring allowed to rotate along with the lower portion of the spring due to the aforementioned widened top slot structure which captures the U-shaped dog.

In a still further embodiment, manufacture of the wire terminal is made considerably easier by providing an inwardly-directed annular projection near the base opening or skirt of the wire terminal such that the assembly process simply involves shoving the spring into the wire terminal as, for instance, with a screw driver or other elongated implement, at which point the spring is inserted through the bottom aperture of the wire terminal and its bottom end collapses on itself being canted in by the sides of the inwardly-projecting ridge until it snaps into place with the lower edge of the spring resting on the top portion of the inwardly-projecting annular lip. The spring is then rotated until the upper dog lies within the upper slot. Thus, the spring is inserted with minimal effort. This increases the production rate by over a factor of 10 since no detents must be bent over the base of the spring after spring insertion. Also, it has been found that wires are securely held in the terminal, whether or not inward projections are used to grab the wire jackets.

Thus, an improved wire terminal is provided in which an internal coiled spring wire clamping member is opened with the usual clockwise twist of the wire terminal when wires are inserted into the wire terminal, with an intermediate portion of the spring initially contacting the wires as they are inserted into the wire terminal such that the clockwise rotation opens an upper spring portion anchored at its end to the wire terminal. Release of the wire terminal causes the spring to collapse on itself to squeeze the wires together, thereby preventing dislodging of the wire terminal as by vibration. Further improvements include an annular lower lip in the housing for ease of spring insertion and capture; an upper U-shaped dog which prevents the upper spring dog from jumping out of its tabbed position with extremely large terminal torquing, while at the same time deflecting inserted wires off axis to prevent terminal cap damage; and a terminal removal system including a dog on the lower portion of the spring and corresponding lost motion channels housing corresponding dogs at both the top and bottom of the terminal.

BRIEF DESCRIPTION OF THE DRAWINGS

These and other features of the subject invention will be better understood when taken in conjunction with the Detailed Description in view of the following Drawings, of which.

DETAILED DESCRIPTION

Figures 1A, 1B, 1C:
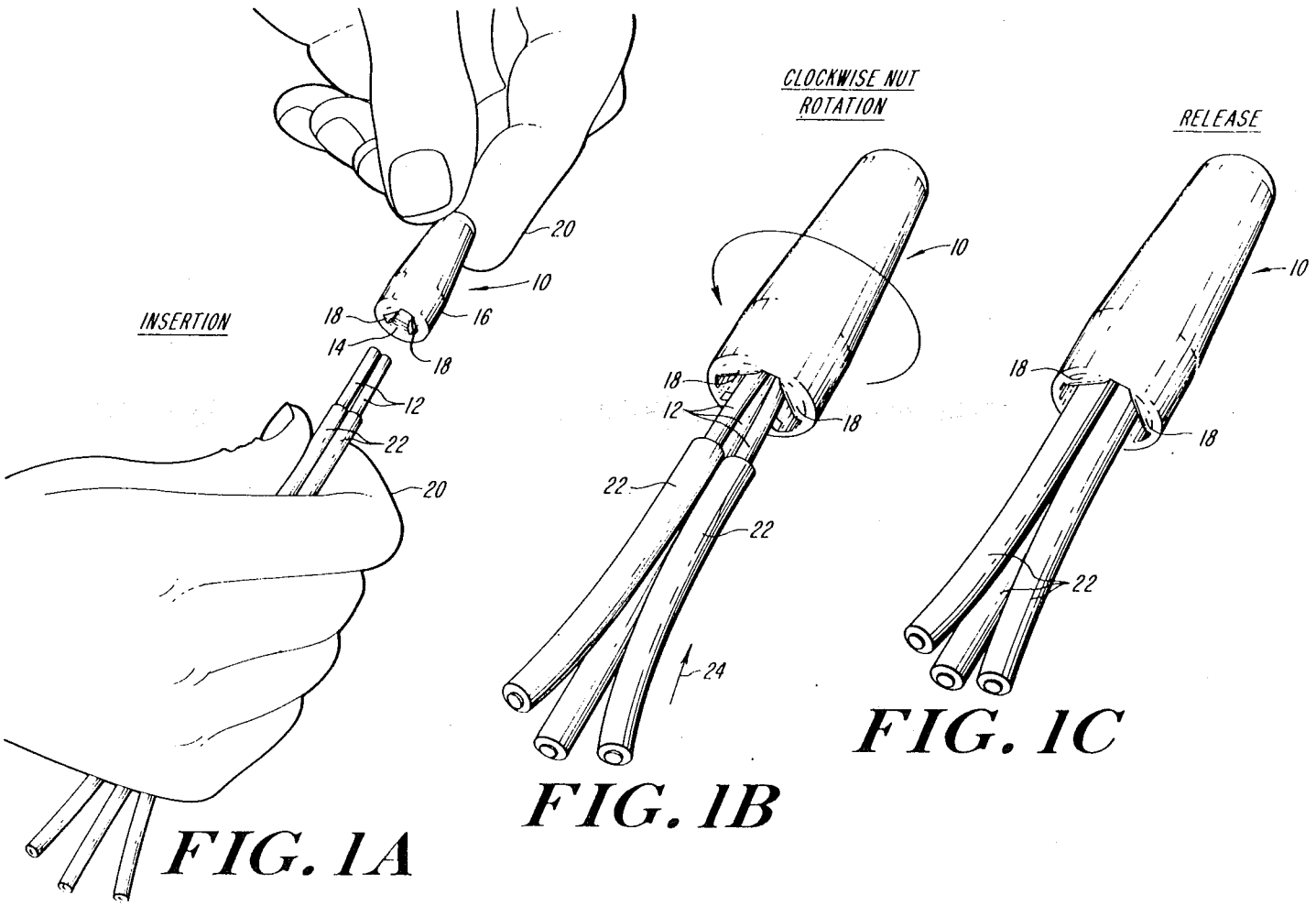
FIGS. 1A, 1B and 1C are diagrammatic illustrations of the utilization of the subject wire terminal through respective stages of insertion, clockwise terminal rotation and release of the terminal.

Referring now to FIG. 1A, a wire terminal 10 is utilized to join a number of conductors or wires 12 by virtue of the manual insertion of wires 12 into orifice 14 of electrically non-conductive wire terminal housing 16, with housing 16 having integral and flexible tabs 18 which serve to retain the wires in the terminal once the terminal has been secured to the wires. The manual insertion is indicated by portions 20 of hands which are utilized in the manual procedure.

Referring to FIG. 1B, once the wires 12 have been inserted into terminal 10, the terminal is rotated in the usual clockwise direction, while at the same time, wires 12 along with outer insulation 22, if any, is forced upwardly in the direction of arrow 24 so as to force the wires into the terminal during the clockwise rotation. As will be described in connection with FIG. 2B, the clockwise rotation opens the internally carried spring member to permit the wires to be easily inserted into the wire terminal rather than the spring being captured in the wire terminal housing and being unable to expand, as is the case conventionally.

Upon insertion of the wires into the wire terminal and the clockwise rotation, release of the wire terminal causes the collapse of the internal spring upon itself which, as will be described hereinafter, presses the electrical conductors together along an extended line in such a manner that they will remain within the wire terminal, with any vibration causing tightening of the spring structure around the conductors so that an extremely stable multiturn electrical connection is made, which connection is only strengthened in the presence of vibration. How this is accomplished is described in connection with FIGS. 2A–2C and FIG. 3.

Figure 2C:
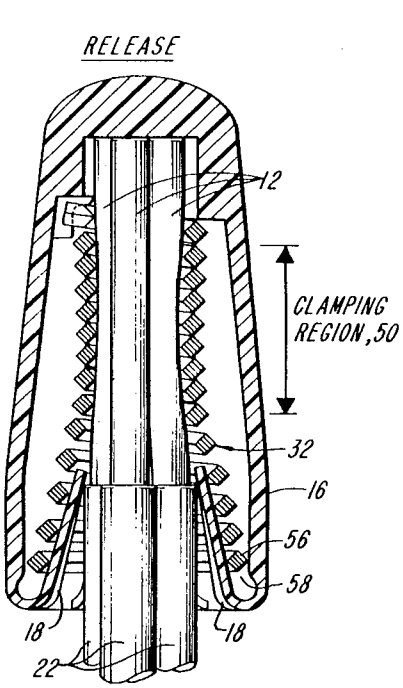
FIGS. 2A, 2B and 2C are respectively cross-sectional illustrations of the wire terminal of FIGS. 1A–1C, illustrating the interior open-ended spring configuration utilized in the wire terminal housing, the locking of the top end of the spring to the wire terminal housing, the top clearance for wire insertion in the top of the wire terminal and the spring tabs which are integral to the wire terminal body for maintaining the insertion in the wire terminal, with FIG. 2A indicating a parallel portion of the interior spring in its unexpanded condition, with FIG. 2B indicating the spring expansion due to terminal rotation which permits insertion of the wires into the wire terminal, and with FIG. 2C indicating the collapse of the parallel portion of the spring about the inserted wires upon release of the wire terminal.
Figure 2B:
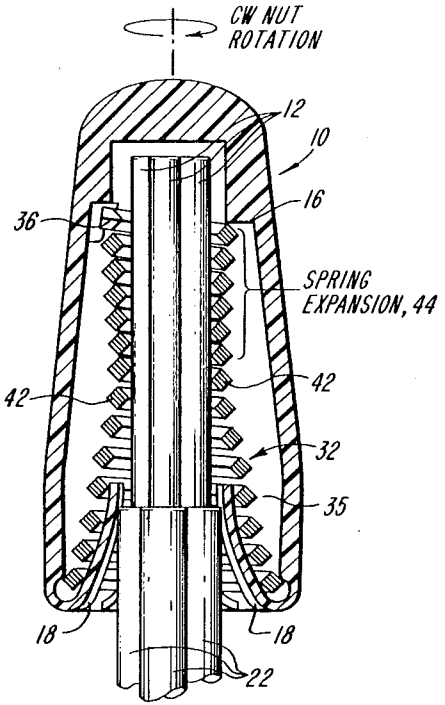
Figure 2A:
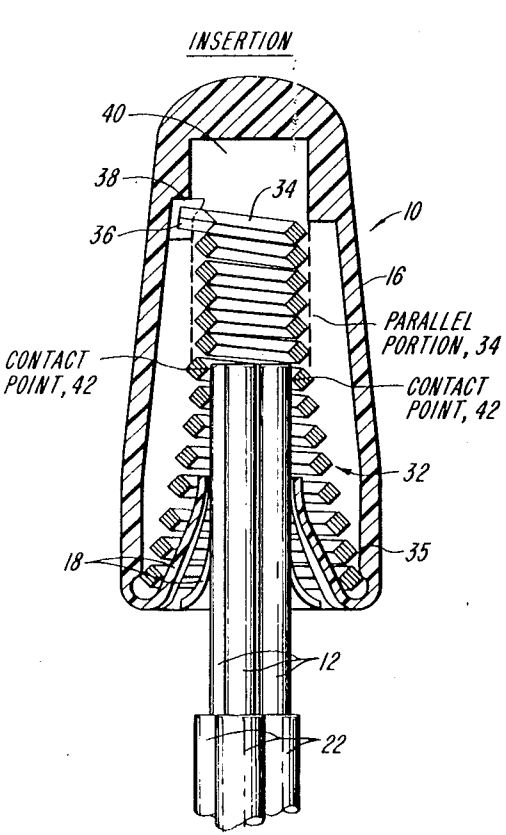

Referring now to FIG. 2A, wire terminal 10 is shown in cross-section as having a housing 16 with an internal cavity 30 which captures a counter-clockwise helically wound spring 32, having a parallel portion 34 and a conical lower portion 35, as illustrated. It will be noted that spring 32 is opened at its top 34 and has an end 36 which is captured in a mating slot 38 in housing 16.

It will also be noted that housing 16 is provided with a cavity 40 into which wires or conductors 12 may be inserted, if so desired, such that the subject nut does not limit to any great extent the ability to insert stripped wires therein.

Referring to FIG. 2A, wires 12 are shown inserted to a point of contact with spring 32 intermediate its length and generally at the bottom end of the parallel portion 34, with the contact point here being illustrated by arrows 42. Note that the top of spring 32 is open-ended in one embodiment. When wires 12 are held in one position, it will be appreciated that the contact point 42, even if momentary, serves as a fixed point such that, as illustrated in FIG. 2B, when the terminal is rotated clockwise, end 36 also rotates clockwise so that spring 32 expands above point 42, as illustrated by the expanded portion 44 of the spring. The clockwise rotation of terminal 10 therefore provides that the upper portion of the spring expands so that wires 12 can be inserted completely through the parallel portion of the spring and into cavity 40 if such is desired.

It will be appreciated that the wires being held stationary, the twisting of the wire terminal expands the upper portion of the spring since there is at least momentary contact between the stationary wires and an intermediate portion of the spring. This contact, even if it is only momentary, is enough to expand the spring until the next clockwise turn of the wire terminal. Thus, with each clockwise turn of the wire terminal, the stationarily-held wires can be advanced into the nut. The momentary contact of the stationary wires at the lower end of the parallel portion of the spring is, in part, due to the initial impulse imparted during a rapid twist of the wire terminal which momentarily opens the upper portion of the spring with each twist.

Thus, the spring expansion is caused by the rotation of end 36 in the clockwise direction since it is captured in slot 38 in body 16 of the wire terminal and since it is rotated with respect to certain momentary points of contact 42.

Figure 3B:
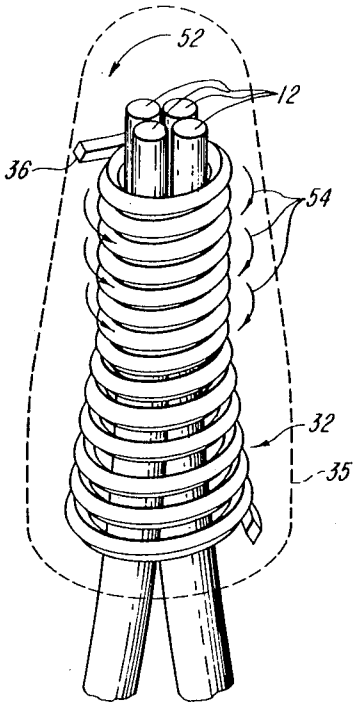
FIGS. 3A and 3B are diagrammatic illustrations of the release of the spring where it contracts upon itself to squeeze the inserted wires together and into electrical contact showing the situation prior to and after wire insertion.
Figure 3A:
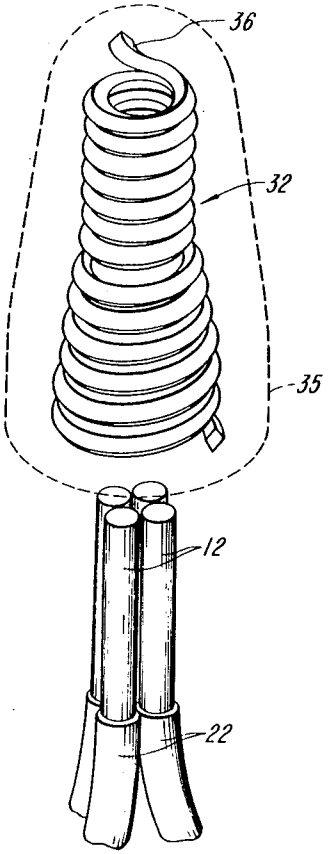

Upon release of the spring, as illustrated in FIG. 2C, the parallel portion collapses upon itself, as illustrated in area 50, forming a multi-turn clamping region which clamps wires or conductors 12 together. This clamping operation is shown in FIGS. 3A and 3B in which the spring is shown in its collapsed condition prior to wire insertion; and in which end 36 moves counter-clockwise in the direction of arrow 52 such that the spring springs back on itself as illustrated by arrows 54 around conductors or wires 12.

As can be seen in each of these drawings, not only is there parallel contact by the spring with respect to the inserted wires over an extended distance, there is no tapering which would tend to force the wires out. Thus, in the subject wire terminal, all applied forces are normal to the longitudinal centerlines of the wires. As a result, during vibration or motion, the spring simply tightens around the wires as opposed to loosening or the wire terminal coming off. The result is that the current building code requirements for taping of wire terminals to wires in commercial establishments can be relaxed.

In order to aid in the stability of the entire wire terminal system, the wire terminal may optionally be provided with the aforementioned integral tabs 18 which are adapted to contact either conductors 12 or their insulating sleeves or jackets 22 such that, in addition to the clamping action of the spring, the terminal is also further held in place on the wires by virtue of the integral tabs. As illustrated, the tabs are integral in the sense that they extend from the bottom periphery of the terminal housing 16 and extend upwardly and inwardly. These tabs may be provided with teeth or other locking means (not shown) as desired.

The spring member itself can be loosely carried within the terminal housing as long as end 36 is within its mating slot 38 and, in one embodiment, the opposite end of the spring, e.g., end 56, is free to move in the cavity 58 at the bottom of the wire terminal housing. As can be seen, the subject wire terminal thus responds to vibration and other movement by tightening on the wires which it is intended to connect as opposed to loosening the connection, with the open-endedness of the spring along with the upper terminal cavity provided permitting insertion up into the wire terminal of the conductors or wires of greatly differing lengths. Thus, the length of wire stripped is not so critical. Note that the wire terminal housing is hollow enough to permit radial movement of a portion of the spring so that the spring may extend in a radial direction during the clockwise terminal rotation.

It will be apparent that were the spring wound in the opposite direction, then a counter-clockwise movement of the terminal would serve the same spring expansion function as illustrated. As such, springs wound in an opposite direction and counter-clockwise twisting are within the scope of this invention. However, a clockwise motion has been described as the preferred embodiment because it is this motion which is most normally associated with providing wire terminals at the terminus of conductors to be joined together.

Figure 4:
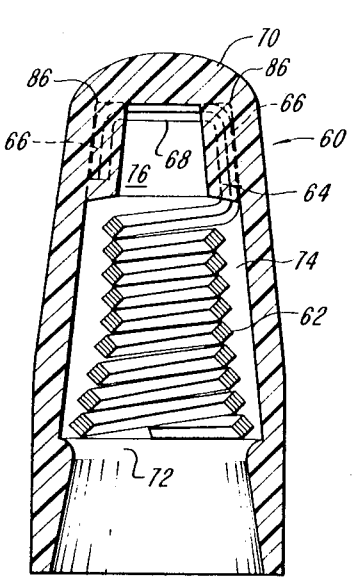
FIG. 4 is a cross-sectional and diagrammatic illustration of an improvement to the subject invention illustrating a U-shaped dog at the top of the spring, and the inwardly depending annular detent formed integral with the terminal housing at its base to permit ease of manufacture.

Referring to FIG. 4, in an improved version of the subject wire terminal, a wire terminal housing 60 includes the aforementioned spring, here illustrated at 62, with spring 62 including a dog or U-shaped driving member 64 having vertically extending parallel sides or legs 66 and a horizontally extending top member 68 carried in a slot (not shown in this figure) at the top cap portion 70 of the wire terminal. The wire terminal housing 60 includes an inwardly-projecting annular surface 72 which, as will be described hereinafter, assists in the assembly of the spring to the wire terminal housing.

As before, the wire terminal housing includes a fairly open chamber here illustrated at 74 with a top chamber here illustrated at 76 similar to that described hereinbefore. Thus, as can be seen in this figure, the wire terminal includes a housing 60 having an inwardly-projecting retaining ridge 72 which enables the spring to be retained within cavity 74, with the uppermost portion of spring 62 encluding a U-shaped dog 64 which is fitted into a slot at the top of the housing of the wire terminal.

Figure 5B:
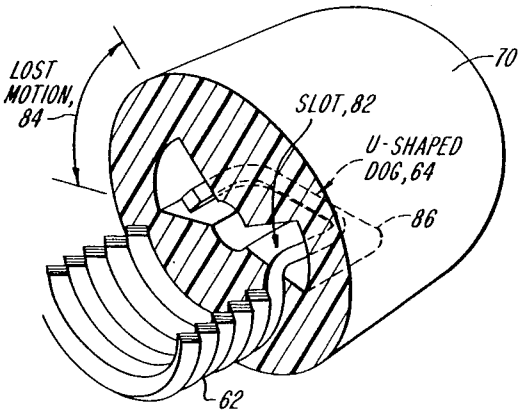
FIG. 5B is a cross-sectional and diagrammatic illustration of the symmetrically widened slot into which the dog of FIG. 5A is provided, thereby to provide for the removal of wires from the wire terminal as illustrated in FIGS. 7, 8 and 9.
Figure 5A:
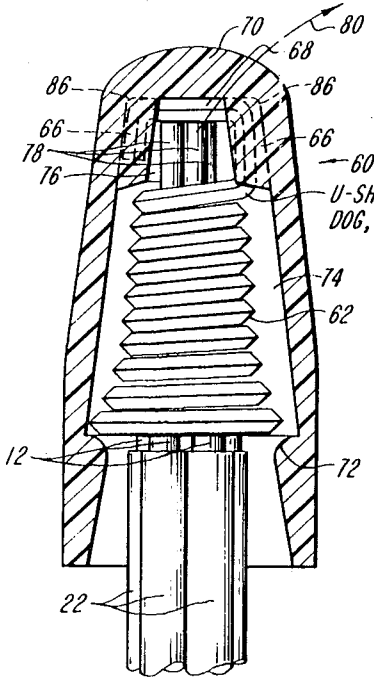
FIG. 5A is a cross-sectional and diagrammatic illustration of an improvement to the subject invention showing the capture of the dog in the upper most part of the wire nut and illustrating also the deflection of inserted wires due to the utilization of the dog as well as the positive capture of the dog on two opposite sides of the wire terminal.

Referring to FIG. 5A, it will be seen that with wires 12 projecting into cavity 74 and through the spring 62, the tops of these wires 78 are deflected offaxis by horizontal member 68 as illustrated by arrow 80 such that jamming the wires up through the wire terminal does not result in damage to the top portion 70 of the housing.

Figure 9:
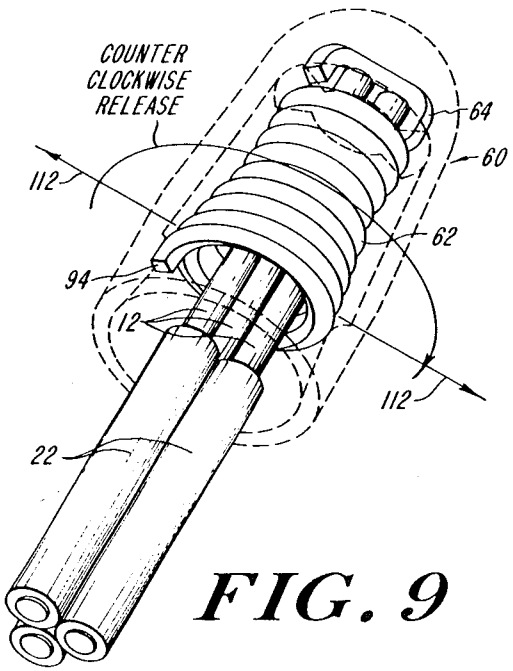
FIG. 9 is a diagrammatic illustration of the removal of wires from the wire terminal in accordance with the structure of FIG. 8, in which counter-clockwise rotation of the wire terminal causes an opening of the spring member holding the inserted wires with the upper portion, or dog, of the spring being moved in its lost motion channel in the direction of the arrow shown, such that the removal of the wires takes place due to the frictional contact of the elongated portion of the wires and the motion of the bottom of the spring.
Figure 8:
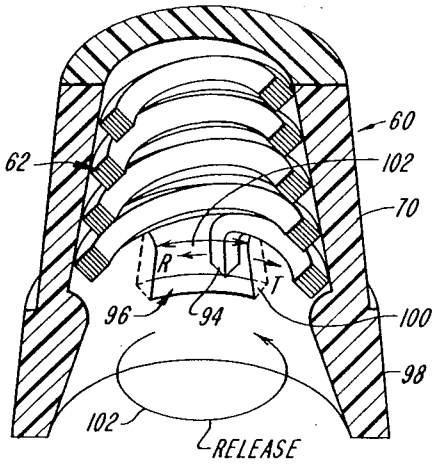
FIG. 8 is a diagrammatic and cross-sectional illustration of the channel in which the downwardly depending dog of FIG. 7 rests, indicating the unwinding action of the bottom of the spring upon a counter-clockwise rotation of the terminal.

Additionally, the U-shaped member 64, as illustrated in FIG. 5B, captures dog 64 in a slot 82 which may either hold the dog snuggly to the top of the terminal, in which case, the terminal is, in general, a non-releaseable wire terminal; whereas, as illustrated in FIG. 5B, there may be some lost motion for the dog as illustrated by the openness of the channel as indicated by arrow 84 to produce lost motion such that, as illustrated in FIGS. 8 and 9, when the terminal is turned in a counter-clockwise direction, the spring bottom moves with the counterrotation of the spring; whereas the top of the spring also moves to a limited extent.

The purpose of the U-shaped dog is that it prevents wire from being pushed through the top of the housing and prevents a simple tab from jumping out of its respective slot when the nut is rotated in a clockwise direction for the joining of the wires projecting through the spring. Thus, the slot having a top portion or wall 86 prevents the spring from popping out of its retaining groove and rising during the twist-on procedure.

Figure 6A:
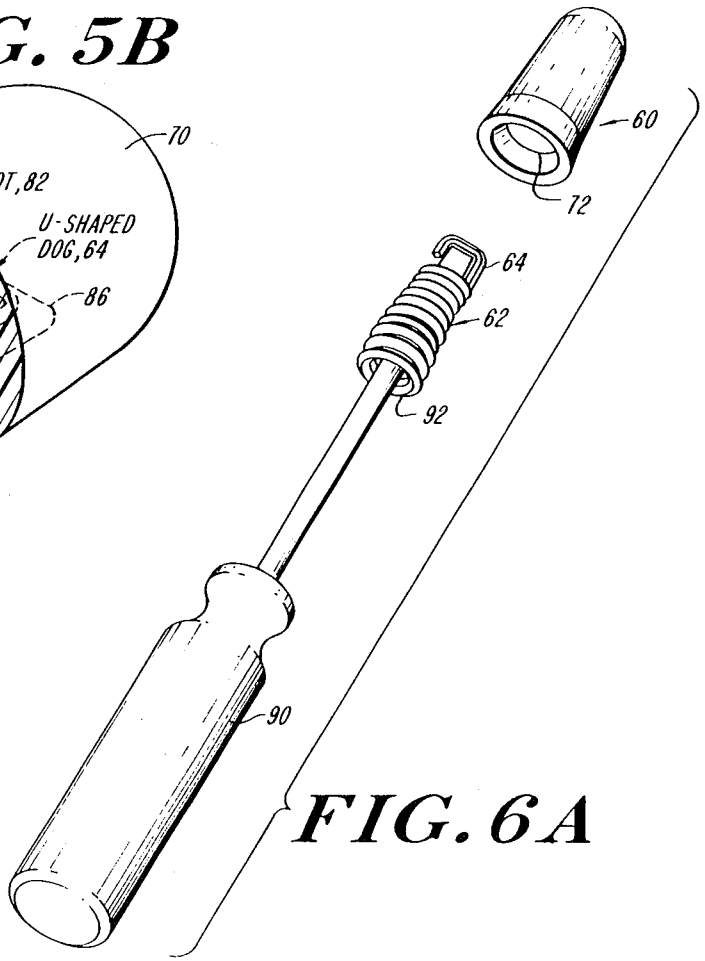
FIG. 6A is a diagrammatic illustration showing the insertion of the spring into the terminal body utilizing a screwdriver or other elongated tool.
Figure 6B:
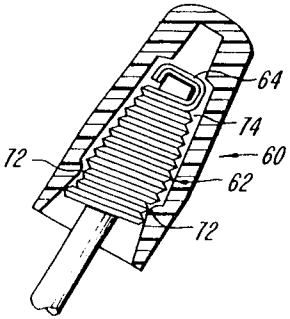
FIG. 6B is a diagrammatic illustration of the subject invention illustrating the compression of the bottom portion of the spring as it passes by the inwardly-directed annular detent ridge when the spring is pushed into the internal cavity of the wire terminal by use of the screwdriver or other elongated instrument in FIG. 6A.

Referring now to FIG. 6A, the aforementioned annular lip and the skirt attached thereto permits the insertion of spring 62 into terminal 60 via the use of a screwdriver 90 or like device which simply pushes the end of spring 62 past the internal lip 72, here shown in dotted outline, such that, as illustrated in FIG. 6B, the bottom 92 of the spring 62 is compressed via the inward projection 72 until the spring end has passed this point, at which point it expands again thereby locking the spring into place in the terminal housing. This provides for an extremely easy assembly procedure which does not require the folding in of tabs or any other complicated moldings to retain the spring in the terminal housing.

Figure 7:
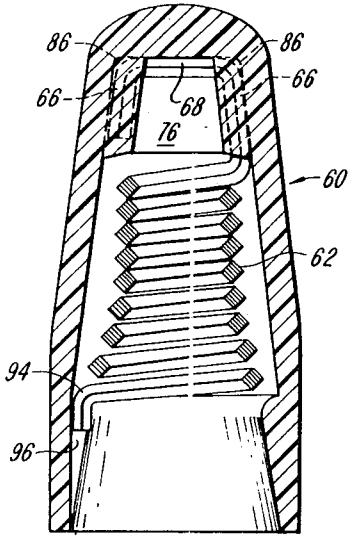
FIG. 7 is a cross-sectional and diagrammatic illustration of the subject invention in which the spring is provided with a downwardly depending dog at the bottom portion thereof which rides in a lost motion channel.

Referring now to FIG. 7, the subject wire terminal is given the possibility of being releaseable through a counter-clockwise twist of the terminal housing as illustrated in FIG. 7 in which a dog 94 at end 94 of spring 62 projects into a lost motion channel 96 which is more readily seen in FIG. 8 to extend from lip 72 into the skirt or shell 98 of terminal housing 70.

This slot serves in the terminal tightening mode as a lost motion device which leaves the end of the spring virtually free; whereas, as shown in FIG. 8, with a counter-clockwise of the terminal body 70, a wall 100 presses against dog 94 such that the terminal in the counterclockwise direction as indicated by arrows 102 results in the opening of the bottom of the spring in much the same way as the opening of the top portion of the spring was accomplished as mentioned hereinbefore.

That is to say, the counter-clockwise rotation of the dog opens the bottom portion of the spring vis-a-vis the friction against the wires contained in the parallel portion of the spring such that the parallel portion of the spring, at least as to its bottom part and also throughtout its whole body, is opened sufficiently to remove the wires. This is, in part, permitted by the lost motion device at FIG. 5B in which slot 82 is sufficiently widened to provide enough lost motion such that the end of the spring 92 can move while simultaneously moving the top part of the spring at least insofar as the friction of the wires within the parallel portion of this spring will provide or permit such motion. Were the slot not slightly opened to permit the lost motion, the bottom part of the spring and the top part of the spring would move simultaneously which would not necessarily result the ability to remove the wires from the wire terminal in certain cases depending on the resiliency of the spring and its contact with the inserted wires. It will be noted that with some movement of the spring at the bottom, at least an intermediate portion of the spring will open with a counter-clockwise twist, regardless of whether the top moves or not. Thus, under some circumstances, the slot for the top dog may be tight and still result in a releaseable wire terminal.

Thus, as seen in FIG. 9, nut 60 is shown being rotated in a counter-clockwise position so as to release wires 12 projecting through spring 62, with the motion of the end 92 of spring 62 being indicated by arrow 110, such that the middle or parallel portion of spring 62 expands as illustrated by arrows 112. Thus the spring opens starting from its base and works upwardly. The top dog 64 of spring 62 is free to move in its slot should it be desired so that the spring will open in the same manner as before due to the friction of the wires working against the torque provided by end 94 as transmitted via the bottom of spring 62 so that it opens on the wires.

While it is possible to obtain release of the wires from the wire terminal with the lost motion device at the top of the wire terminal, a certain amount of loosening of the wires can be achieved even if dog 64 is captured completely in a slot at the top of the wire terminal due to the flexibility of the top of the spring and the fact that the wires are, in general, caught in the parallel portion of the spring which will, in fact, open somewhat even if there is no lost motion as the dog top portion of the spring. It is, however, suggested that there be lost motion provided for the top portion of the spring of at least in an arc of 60 degrees such that during counter-clockwise rotation, the top part of the spring is not driven with the bottom part of the spring. This emulates the action of the wire insertion and tightening in which the bottom part of the spring is allowed to float, in this case, in a lost motion channel 96 of FIG. 8.

Note, with respect to the upper dog or spring tab, under certain situations, it may be desireable to have the tab come out of its slot to prevent over-torquing of the wire terminal. Such a nut is a safety terminal which prevents internal damage due to over-torquing and is thus part of the subject invention. The torque necessary to drive the upper dog or tab out of its slot depends on the spring properties and the slot configuration with the subject invention not being limited to any one type configuration. Suffice it to say that with sufficient force, the FIG. 2, 4 and 7 embodiments can result in tab or dog slippage and can therefore serve as safety terminal.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. A wire terminal for the electrical connection of wires or conductors comprising:

an electrically non-conductive housing having an interior cavity, and an apertured base and slot at the top of said cavity;

a helical spring having a top end permanently retained in said slot such that torque is always transmitted to the top end of the spring upon insertion of wires into said terminal and upon a twist to said terminal in a predetermined direction, and, space between said housing and an intermediate portion of said spring to permit expansion upon insertion of wires, such that upon first twist of said terminal an upper portion of said spring expands radially within said cavity upon at least momentary contact between the inserted wires and an intermediate portion of said spring thus permitting further insertion of the wires, and such that upon release of said terminal, said spring collapses down upon the inserted wires for a tight secure connection along a number of turns of said spring such that there is contact by said spring with respect to the inserted wires over an extended distance, the bottom of said spring being free to move rotationally at least to a limited extent, the top end of said spring having a U-shaped dog having legs and said slot receiving at least the legs of said U-shaped dog.

2. The wire terminal of claim 1 wherein said slot is widened to provide a lost motion action for said dog during a terminal removal operation.

3. The wire terminal of claim 1 wherein the bottom end of said spring includes a bottom dog and wherein said housing includes a lost motion producing channel to receive said bottom dog such that the wire terminal may be properly installed with a predetermined rotation of said terminal and wherein said terminal may be removed by an opposite rotation which rotates the bottom of said spring so as to open said spring to permit wire removal.

4. The wire terminal of claim 3 wherein said slot is widened to provide a lost motion action for said dog during a terminal removal operation.

* * * * *